US009182082B2

(12) United States Patent
Zhu

(10) Patent No.: US 9,182,082 B2
(45) Date of Patent: Nov. 10, 2015

(54) LED-LIGHT HEATSINK AND LED LAMP

(71) Applicants: BOE TECHNOLOGY GROUP CO., LTD., Beijing (CN); SUZHOU BOE CHATANI ELECTRONICS CO., LTD., Jiangsu (CN)

(72) Inventor: Ling Zhu, Beijing (CN)

(73) Assignees: BOE TECHNOLOGY GROUP CO., LTD., Beijing (CN); SUZHOU BOE CHATANI ELECTRONICS CO., LTD., Suzhou, Jiangsu (CN)

( * ) Notice: Subject to any disclaimer, the term of this patent is extended or adjusted under 35 U.S.C. 154(b) by 60 days.

(21) Appl. No.: 13/805,720

(22) PCT Filed: Oct. 16, 2012

(86) PCT No.: PCT/CN2012/083033
§ 371 (c)(1),
(2) Date: Dec. 20, 2012

(87) PCT Pub. No.: WO2013/078923
PCT Pub. Date: Jun. 6, 2013

(65) Prior Publication Data

US 2013/0140974 A1 Jun. 6, 2013

(30) Foreign Application Priority Data

Dec. 2, 2011 (CN) ..... 2011 1 0397971

(51) Int. Cl.

| | |
|---|---|
| ***F21V 29/00*** | (2015.01) |
| ***F21K 99/00*** | (2010.01) |
| ***F21V 29/77*** | (2015.01) |
| ***F21V 29/85*** | (2015.01) |

(Continued)

(52) U.S. Cl.
CPC ..... *F21K 9/13* (2013.01); *F21V 29/773* (2015.01); *F21V 29/85* (2015.01); *F21V 29/83* (2015.01); *F21Y 2101/02* (2013.01)

(58) Field of Classification Search
CPC ..... F21V 29/2293; F21V 29/2206
USPC ..... 313/46
See application file for complete search history.

(56) References Cited

U.S. PATENT DOCUMENTS

| | | | | |
|---|---|---|---|---|
| 7,824,077 | B2 * | 11/2010 | Chen et al. | 362/345 |
| 2006/0261470 | A1 * | 11/2006 | Schick | 257/718 |

(Continued)

FOREIGN PATENT DOCUMENTS

| | | | |
|---|---|---|---|
| CN | 201059520 | Y | 5/2008 |
| CN | 101210664 | A | 7/2008 |

(Continued)

OTHER PUBLICATIONS

Fourth Chinese Office Action Appln. No. 2011103979710; Dated Aug. 22, 2014.

(Continued)

*Primary Examiner* — Nimeshkumar Patel
*Assistant Examiner* — Jacob R Stern
(74) *Attorney, Agent, or Firm* — Ladas & Parry LLP

(57) ABSTRACT

The present invention provides an LED-light heatsink and a light-emitting diode (LED) lamp having the same heatsink. The LED-light heatsink comprises: a hollow heatsink body; and a heatsink baseplate for enclosing one end of the heatsink body. The present invention can significantly improve the heat-dissipation effect of an LED-light.

20 Claims, 4 Drawing Sheets

(51) Int. Cl.

| | |
|---|---|
| *F21Y 101/02* | (2006.01) |
| *F21V 29/83* | (2015.01) |

(56) References Cited

U.S. PATENT DOCUMENTS

| | | | | |
|---|---|---|---|---|
| 2008/0158887 | A1* | 7/2008 | Zhu et al. | 362/294 |
| 2008/0175003 | A1 | 7/2008 | Tsou et al. | |
| 2010/0207534 | A1* | 8/2010 | Dowling et al. | 315/186 |
| 2010/0259932 | A1 | 10/2010 | Horng et al. | |
| 2011/0080096 | A1* | 4/2011 | Dudik et al. | 315/112 |
| 2011/0156569 | A1* | 6/2011 | Osawa | 313/46 |
| 2011/0234076 | A1* | 9/2011 | Simon et al. | 313/46 |
| 2013/0154465 | A1* | 6/2013 | Anderson | 313/45 |

FOREIGN PATENT DOCUMENTS

| | | | |
|---|---|---|---|
| CN | 101340799 | A | 1/2009 |
| CN | 201302141 | Y | 9/2009 |
| CN | 201606843 | U | 10/2010 |
| CN | 201706337 | U | 1/2011 |
| CN | 201764306 | U | 3/2011 |
| CN | 102003694 | A | 4/2011 |
| CN | 201925887 | U | 8/2011 |
| CN | 102635839 | A | 8/2012 |
| JP | 2011-108493 | A | 6/2011 |
| KR | 101052894 | A | 7/2011 |

OTHER PUBLICATIONS

First Korea Office Action dated Feb. 27, 2014; Appln. No. 10-2012-7031722.

Third Chinese Office Action dated Apr. 1, 2014; Appln. No. 201110397971.0.

International Preliminary Report on Patentability dated Jun. 3, 2014 PCT/CN2012/083033.

First Chinese Office Action dated Jan. 4, 2013; Appln. No. 201110397971.0.

Second Chinese Office Action dated Sep. 18, 2013; Appln. No. 201110397971.0.

Korean Examination Opinion dated Aug. 20, 2014; Appln. No. 10-2012-7031722.

International Search Report dated Dec. 2, 2011; PCT/CN2012/083033.

Korean Office Action Appln. No. 10-2012-7031722; Dated Feb. 10, 2015.

* cited by examiner

LED-LIGHT HEATSINK AND LED LAMP

TECHNICAL FIELD

The present invention relates to an LED-light heatsink and an LED lamp.

BACKGROUND

LED (Light-Emitting Diode) lights have been used in more and more applications because of its advantages of high brightness, energy saving, and etc. But an LED light source usually has a relatively large amount of heat generation, which makes heat-dissipation necessary for an LED light source to guarantee its normal work.

SUMMARY

Embodiments of the present invention provide an LED-light heatsink and an LED lamp, which can improve the heat-dissipation effect of an LED-light.

According to an embodiment of the present invention, there is provided an LED-light heatsink, which comprises: a hollow heatsink body; and a heatsink baseplate provided at one end of the heatsink body.

The heatsink body may be provided with a plurality of fins on an exterior wall thereof.

Preferably, the heatsink baseplate has a thickness at its center greater than the thickness at an edge thereof.

Preferably, the fins are formed with a certain angle to the exterior wall of the heatsink body, and the angle is less than 90°, preferably in a range of 80-45°, and more preferably in a range of 80-60°.

Preferably, the fins have a thickness at a portion thereof close to the heatsink body greater than the thickness at a portion thereof away from the heatsink body. Alternatively or additionally, the fins may have a height at a portion thereof close to the heatsink baseplate greater than the height at a portion thereof away from the heatsink baseplate.

According to some examples, the fins are provided with a bifurcation at a portion thereof close to the heatsink baseplate.

The heatsink baseplate may be provided thereon with at least one open hole corresponding to a single LED-light.

Preferably, an average height H of the fins is 3-4 times larger than a spacing d between the fins.

Preferably, an average thickness m of the fins, a length l of the fins, and a spacing d between the fins satisfy a relation of:

$$\frac{m}{l} \leq \frac{1}{18}, \frac{l}{d} = \frac{75}{6.5}.$$

Preferably, an average thickness C of the heatsink baseplate is 2-3 times larger than the average thickness m of the fins.

According to some examples, an average thickness of the heatsink baseplate is 4.5-5.8 mm.

According to some examples, a spacing d between the fins is 3.3-4.5 mm, an average thickness m of the fins is 2.0-2.7 mm, an average height H of the fins is 6.5-9.0 mm, and a length l of the fins is 40-50 mm.

The number N of the fins, for example, is 16, 18 or 20

According to an embodiment of the present invention, there is also provided an LED lamp, which comprises: an LED-light heatsink as described above and at least one single LED-light located within the LED-light heatsink.

BRIEF DESCRIPTION OF THE DRAWINGS

In order to clearly illustrate the technical solutions of the embodiments of the invention, the drawings of the embodiments will be briefly described in the following; it is obvious that the described drawings are only related to some embodiments of the invention and thus are not limitative of the invention.

DETAILED DESCRIPTION

In order to make objects, technical details and advantages of the embodiments of the invention apparent, the technical solutions of the embodiments will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

Figure 1:
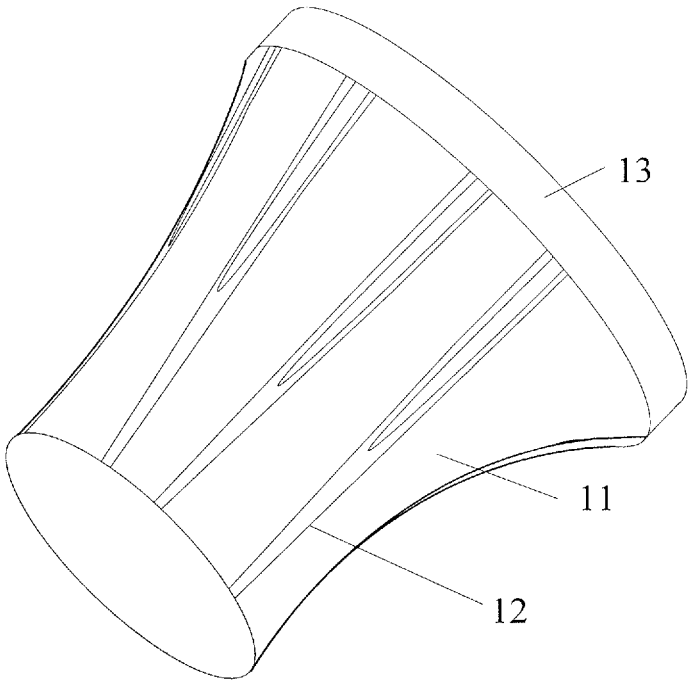
FIG. 1 is a schematic structural view of an LED-light heatsink according to an embodiment of the present invention.

As shown in FIG. 1, an LED-light heatsink according to an embodiment of the present invention comprises: a hollow heatsink body 11, provided with a plurality of fins 12 on an exterior wall thereof; and a heatsink baseplate 13 used for enclosing a bottom of the heatsink body 11.

Further, as shown in FIG. 1, the heatsink body 11 may be in a cylindrical shape, and the heatsink baseplate 13 may be in a circular shape.

Further, the heatsink baseplate 13 has a thickness at its center greater than the thickness at an edge thereof. The heatsink baseplate 13 may have a thickness that decreases gradually from the center to the edge thereof, or may have a thickness that decreases in steps from the center to an edge thereof. When a heat source is located in an intermediate zone of the heatsink, such a design mode is most beneficial to the thermal conductivity, which enables the heat generated by the heat source to be dissipated from the intermediate zone to the surroundings.

Figure 2:
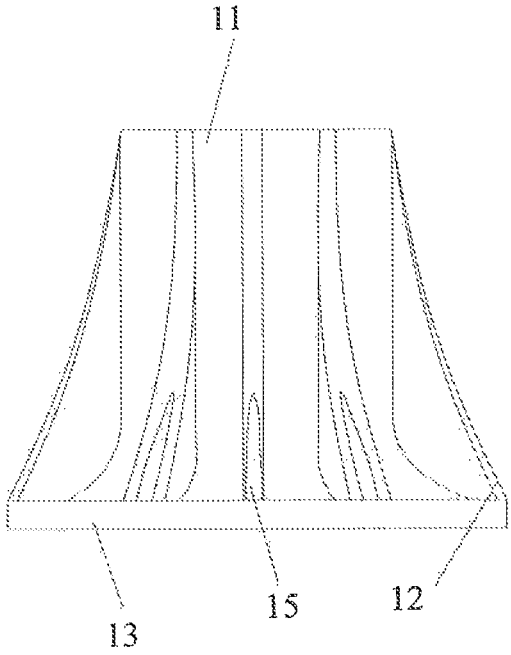
FIG. 2 is a schematic front view of an LED-light heatsink according to an embodiment of the present invention.

Further, as shown in FIG. 2, the fins 12 in the present invention are formed with a certain angle to an exterior wall of the heatsink body 11, and the angle is less than 90°. That is, the fins in the present invention are designed to be oblique fins. If oblique and curved fins are adopted, the heat-storage effect may be relatively good, and the heat-transfer area is relatively large, but the flow-resistance coefficient is increased; the difficulty of realizing the manufacture processes is increased as well. If straight fins are adopted, the flow-resistance coefficient is small, but the heat-storage effect may be not very good, and the heat-transfer area is relatively small. The fins in the embodiment of the present invention have a form of an oblique fin, which can ensure a good heat-storage effect, a sufficient heat-transfer area, and a relatively small flow-resistance coefficient.

Figure 3:
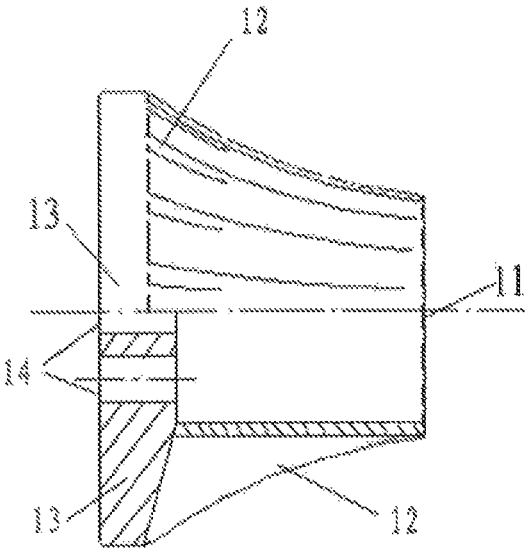
FIG. 3 is a left view of an LED-light heatsink according to an embodiment of the present invention.

Further, as shown in FIG. 2 and FIG. 3, the fins 12 may have a thickness at a portion thereof close to the heatsink body 11 greater than the thickness at a portion thereof away from the heatsink body 11. Alternatively or additionally, the fins 12 may have a height at a portion thereof close to the heatsink baseplate 13 greater than the height at a portion thereof away from the heatsink baseplate 13.

Preferably, the fins 12 in the present invention have a thickness that decreases gradually from a fin bottom to a fin top, and the fin bottom is the portion of the fin 12 close to the heatsink body 11, and the fin top is the portion of the fin 12 away from the heatsink body 11. Since the heat is transferred from down to up, it is necessary to consider not only the heat-dissipation but also the heat-storage for the bottom of the fins to prevent an impact of a thermal load. The heat is diminished when it is dissipated upward, and accordingly, the thickness of the fins decreases gradually. Alternatively, the thickness of the fins 12 also may decrease in steps from the fin bottom to the fin top.

The height of the fins 12 decreases gradually to zero from the bottom to the top; the bottom is the portion of the fin 12 close to the heatsink baseplate 13, and the top is the portion of the fin 12 away from the heatsink baseplate 13. Further, the height of the fins 12 also may decrease in steps to zero from the bottom to the top.

Further, as shown in FIG. 2, the fins 12 are provided with a bifurcation 15 at the bottom thereof, so as to increase the heat-dissipation area when the heat is conducted to an upper portion of the fins.

Figure 4:
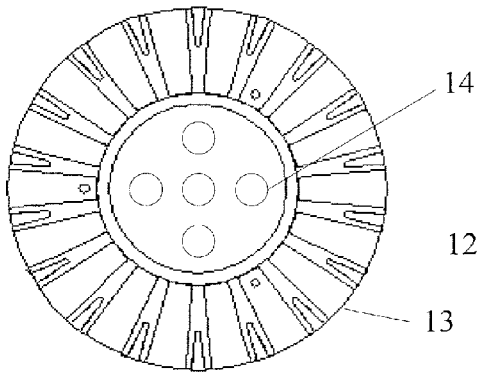
FIG. 4 is a top view of an LED-light heatsink according to an embodiment of the present invention.

Further, as shown in FIG. 4, the heatsink baseplate 13 is provided thereon with at least one open hole 14 corresponding to a single LED-light, which can increase air convection and improve the heat-dissipation effect.

In this embodiment of the present invention, the LED-light heatsink comprises a heatsink body and a heatsink baseplate. The heatsink body may be provided with a plurality of oblique fins on an exterior wall thereof. The fins have a thickness that decreases gradually from a bottom to a top thereof, and/or have a height that decreases gradually to zero from the bottom to the top. The fins are provided with a bifurcation at the bottom thereof, so that when the LED-light is in operation, the generated heat can reach the heatsink body and be transferred to the oblique fins by way(s) of conduction, convection, and radiation, etc. The oblique fins increase the heat-dissipation area, and thus can improve the heat-dissipation effect of the LED-light. In addition, the heatsink baseplate has a thickness that decreases gradually from the center to an edge thereof, which enables the heat generated by the heat source to be dissipated from the center to the surroundings, and thus is beneficial to the thermal conductivity. The heatsink baseplate also may be provided with a plurality of open holes corresponding to single LED-lights respectively, which can increase air convection and further improve the heat-dissipation effect.

In addition, it is also possible to design some relevant parameters of the LED-light heatsink, so as to further improve the heat-dissipation effect of the LED-light heatsink. The relevant parameters of the LED-light heatsink that are involved in the present invention, mainly include: fin spacing d, average thickness m of the fins, average height H of the fins, length l of the fins, and thickness C of the heatsink baseplate.

(1) Fin Spacing d

In natural convection, it is necessary for a certain fin spacing to meet the requirements of natural convection; otherwise the mutual heat-dissipation between the fins is affected due to an effect of thermal vortex. In forced convection, the fin spacing may be slightly smaller.

Through a simulation using a computer software ANSYS, the effect of the fin spacing d on a maximum temperature of the LED-light heatsink can be verified with the environmental parameters set as follows: a natural convection mode is employed, and the convective heat-transfer coefficient is 7.01 W/M2·K; the ambient temperature is 25° C.; the heat flux density of the heatsink is 1250 $W/M^2$; and the LED-light heatsink is manufactured by using a process of aluminum extrusion or die-casting.

Figure 5:
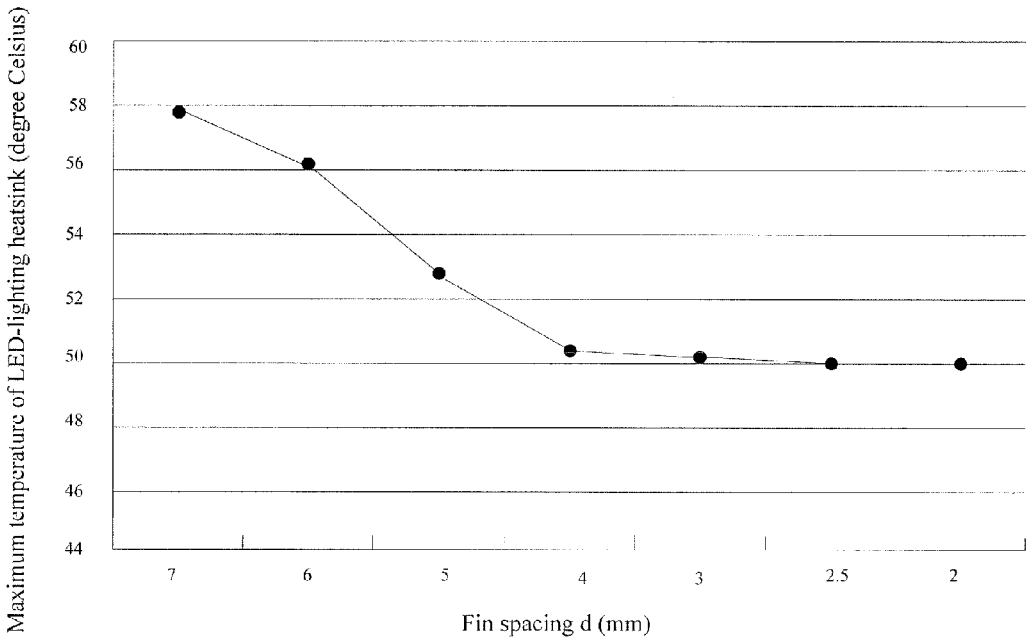
FIG. 5 is a schematic diagram of a relationship between a maximum temperature and a fin spacing of the LED-light heatsink.

As shown in FIG. 5, it is a schematic diagram of a relationship between the maximum temperature of the LED-light heatsink and the fin spacing d. As the fin spacing d decreases and the number of the fins increases, the heat-dissipation surface area is increased, and therefore, theoretically, the maximum temperature of the LED-light heatsink should be getting lower and lower. However, as it can be seen from the figure, when the fin spacing d decreases to a certain extent, in the case of natural convection, the change of the lowering of the maximum temperature of the LED-light heatsink gradually tends toward flat; therefore, it is not true that the smaller the fin spacing is, the better it is, instead, an appropriate spacing needs to be selected.

In the embodiment of the present invention, in order to achieve a relatively good heat-dissipation effect, the value of the fin spacing d may be 3.3-4.5 mm.

(2) Average Thickness m of the Fins

In natural convection, it is necessary for a certain fin thickness to increase the heat-storage capacity of the LED-light heatsink as well as the buffer effect to a heat flow, in order to increase the heat capacity; in forced convection, the thickness of the fins may be smaller.

Through a simulation using a computer software ANSYS, the effect of the average thickness m of the fins on the maximum temperature of the LED-light heatsink can be verified with the environmental parameters set as follows: a natural convection mode is employed, and the convective heat-transfer coefficient is 7.01 W/M2·K; the ambient temperature is 25° C.; the heat flux density of the heatsink is 1250 $W/M^2$; and the LED-light heatsink is manufactured by using a process of aluminum extrusion or die-casting.

Figure 6:
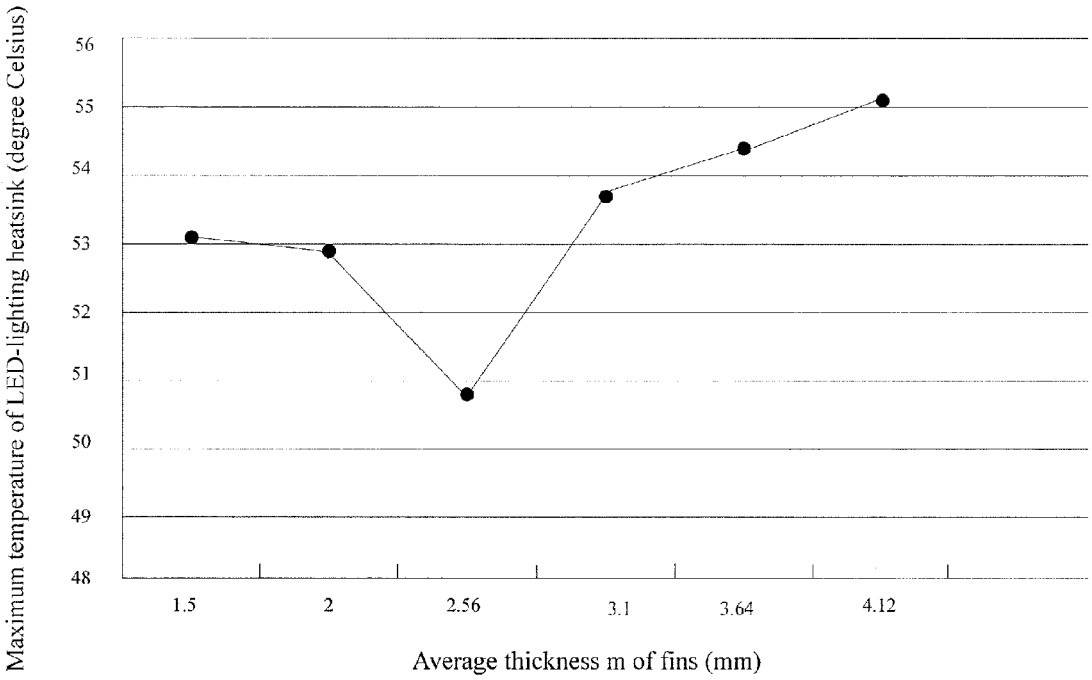
FIG. 6 is a schematic diagram of a relationship between a maximum temperature and a fin thickness of the LED-light heatsink.

As shown in FIG. 6, it is a schematic diagram of a relationship between the maximum temperature of the LED-light heatsink and the average thickness m of the fins. As it can be seen from FIG. 6, when the value of m is relatively small, the change of the maximum temperature of the LED-light heatsink is not obvious; when m gradually increases and reaches 2.56 mm, the maximum temperature of the LED-light heatsink is at its lowest value; when m further increases, since the heat-dissipation area gradually decreases as the fin thickness increases, the maximum temperature of the LED-light heatsink gradually increases. Therefore, it is necessary to select an appropriate thickness m of the fins.

In the embodiment of the present invention, in order to achieve a relatively good heat-dissipation effect, the value of the average thickness m of the fins may be 2.0-2.7 mm.

(3) Average Height H of the Fins

The height of the fins can be relatively large, but it will be restricted by the volume shape of the heatsink. The increase of the average height H of the fins has great impact on heat loss in natural convection. Generally, the average height H of the fins does not exceed 3 to 4 times of the fin spacing d; otherwise it will result in a relative large density of arrangement of the fins and ultimately affect a thermal reflow. On condition that the thermal reflow is not affected, the height of the fins is generally the higher the better, which can increase the heat-dissipation surface area. In the embodiment of the present invention, in order to achieve a relatively good heat-dissipation effect, the average height H of the fins may be 3d-4d, and specifically, the value of the average height H of the fins may be 6.5-9.0 mm.

(4) Length l of the Fins

The length of the fins is generally determined according to the volume shape of the LED-light heatsink. In the embodiment of the present invention, in order to achieve a relatively good heat-dissipation effect, the length l of the fins may satisfy the following formula:

$$\frac{m}{l} \leq \frac{1}{18}, \frac{l}{d} = \frac{75}{6.5}.$$

Specifically, the value of the length l may be 40-50 mm.

(5) Thickness C of the Heat-Dissipation Baseplate

In designing the thickness of the heatsink baseplate, if the heatsink baseplate is too thin, the thermal resistance is reduced, but the heat-storage effect is not good, while it is necessary in the design of the heatsink to consider a steady-state buffer effect to a heat flow, for resisting a transient heat load; if the heatsink baseplate is too thick, the thermal resistance is relatively large, and the weight and cost of the heatsink is increased, and therefore, the thickness of the heatsink baseplate should be moderate.

Through a simulation using a computer software ANSYS, the effect of the average thickness C of the heatsink baseplate on the maximum temperature of the LED-light heatsink can be verified with the environmental parameters set as follows: a natural convection mode is adopted, and the convective heat-transfer coefficient is 7.01 W/M2·K; the ambient temperature is 25° C.; the heat flux density of the heatsink is 1250 $W/M^2$; and the LED-light heatsink is manufactured by using a process of aluminum extrusion or die-casting.

Figure 7:
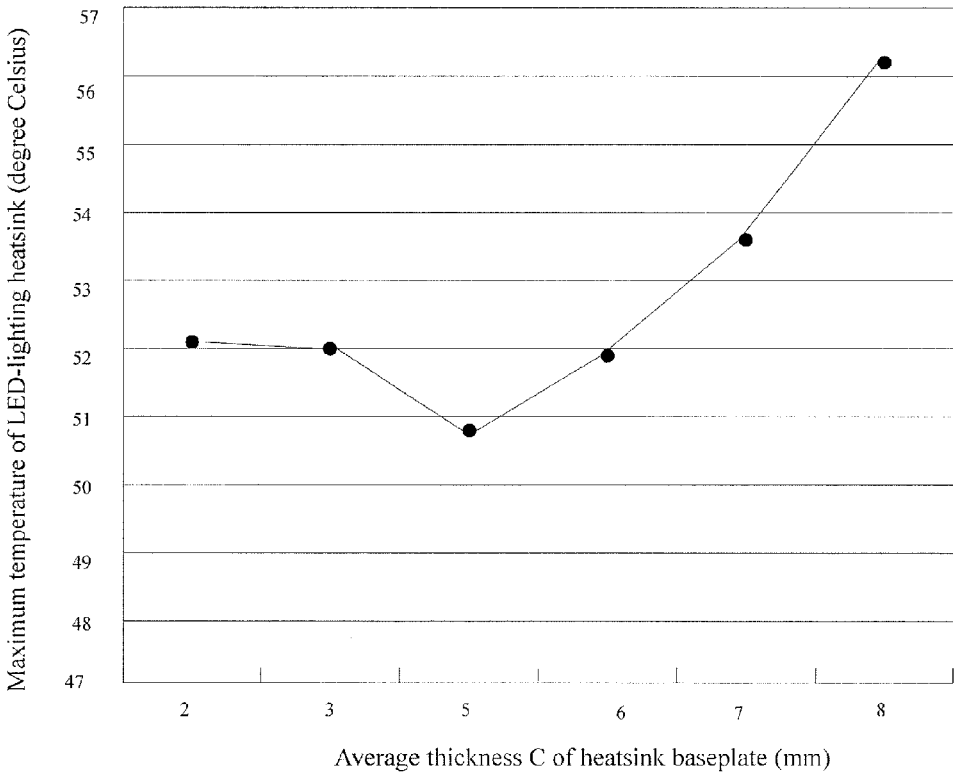
FIG. 7 is a schematic diagram of a relationship between a maximum temperature and a heatsink baseplate thickness of the LED-light heatsink.

As shown in FIG. 7, it is a schematic diagram of a relationship between the maximum temperature of the LED-light heatsink and the average thickness C of the heatsink baseplate. As it can be seen, when the heatsink baseplate is relatively thin, the change of the maximum temperature is not great; when C is 5 mm, the maximum temperature of the LED-light heatsink is at its lowest value; when C gradually increases, since the thermal resistance is gradually increased, the maximum temperature of the LED-lights heatsink gradually increases. Therefore, it is necessary to select an appropriate thickness of the heatsink baseplate.

In addition, when the fins are relative long and relatively high, the thickness of the baseplate needs to be relatively thick. In the embodiment of the present invention, in order to achieve a relatively good heat-dissipation effect, the average thickness C of the heatsink baseplate may be 2-3 times larger than the average thickness m of the fins. Specifically, the value of the thickness C may be 4.5-5.8 mm.

(6) Other Values a. It is also possible to determine the average thickness m of the fins and the fin spacing d, depending on a natural convection airflow velocity $V_0$: the smaller the natural convection airflow velocity is, the thicker the fins are, and the greater the spacing is; in addition, for natural convection, the fin spacing needs to be above 4 mm. Specifically, when $V_0$=1 m/s, we choose d=4.2 mm, m=1.65 mm; and when $V_0$=0.5 m/s, we choose d=5 mm, m>1.65 mm.

b. It is possible to determine the average height H and average thickness m of the fins, depending on requirements of the heat-transfer efficiency and the heat-dissipation surface area. The higher and thinner the fins are, the more weakened the ability for transferring heat to the top of the fins is; the shorter and thicker the fins are, the more reduced the heat-dissipation surface area is.

c. It is possible to determine the average thickness C of the heatsink baseplate, depending on a heat dissipated power Q of the LED-light; a relationship between the heat dissipated power Q and the average thickness C of the heatsink baseplate is: C=7×1gQ−6.

d. It is possible to choose a different average height H and a different average thickness m of the fins, depending on a different average thickness C of the heatsink baseplate, as shown in Table 1:

TABLE 1

| C (mm) | 2-4 | 4-6 | 6-8 | 8-10 | Above 10 |
|---|---|---|---|---|---|
| m (mm) | 1.5 | 2 | 2.5 | 3 | 4 |
| H (mm) | >6 | >8 | >8 | >10 | >10 |

In summary, based on the above design principles, preferably, in the embodiment of the present invention, the average thickness C of the heatsink baseplate may be 4.8-5.5 mm; the spacing d may be 3.5-4 mm; the average thickness m of the fins may be 2.5-2.7 mm; the average height H of the fins may be 7-8.96 mm; the length l of the fins may be 40-46 mm; the number N of the fins may be 16, 18 or 20.

With an LED-light having a total power of less than 6 W as an example, the heat-dissipation effect of the LED-light heatsink made based on the above parameters is verified with the following environmental parameters used in an experiment: natural convection is employed, and the convective heat-transfer coefficient is 7.01 W/M2·K; the ambient temperature is 25° C.; the heat flux density of a single LED-light is 13121.82 $W/M^2$, and the heat flux density of the heatsink is 1250 $W/M^2$. When the LED-light heatsink is manufactured by using a process of aluminum extrusion, the maximum temperature at the pins of the LED-light is 53.379° C., and the maximum temperature at the surfaces of the LED-light heatsink is 50.684° C.; when the LED-light heatsink is manufactured by using a process of die-casting, the temperature at the pins of the LED-light is 53.779° C., and the temperature at the surfaces of the LED-light heatsink is 50.888° C.

In the prior art, an LED-light heatsink is generally not provided with a baseplate, the number of fins provided on the heatsink body is relatively large (30-45), the spacing between the fins is relatively small (1.0-2.0 mm), the fins are relatively low (the average height H is generally 2.5-5.0 mm), and the fins are relatively short (15-35 mm). The design of the above parameters affects the heat-storage effect of the heatsink and the steady-state buffer effect to a heat flow, and thus makes the heat-dissipation effect of the LED-light not good; generally, for an existing LED-light with a total power of 6 W, the actually measured temperature at the pins is about 70° C., and the temperature at the surfaces of the heatsink is 60° C. Based on the above data, it can be seen that, the LED-light heatsink of the present invention has a significant heat-dissipation effect.

An embodiment of the present invention also provides an LED lamp, which comprises: an LED-light heatsink as shown in FIGS. 1-4, and at least one single LED-light located within the LED-light heatsink.

The above description is the preferred implementations of the present invention. It should be noted that, for the ordinary skilled in the art, improvements and modifications can be made without departing from the principles described in the present invention, also these improvements and modifications should be regarded as within the scope of the present invention.

The invention claimed is:

1. An LED-light heatsink, comprising:

a hollow heatsink body; and a heatsink baseplate provided at one end of the heatsink body, wherein the heatsink body is provided with a plurality of fins on an exterior wall thereof;

the heatsink baseplate has a thickness at a center greater than the thickness at an edge thereof; and an average thickness m of the fins, a length l of the fins, and a spacing d between the fins satisfy a relation of:

$$\frac{m}{l} \leq \frac{1}{18}, \frac{l}{d} = \frac{75}{6.5}.$$

2. The LED-light heatsink according to claim 1, wherein the fins are formed with a certain angle to the exterior wall of the heatsink body, and the angle is less than 90°.

3. The LED-light heatsink according to claim 1, wherein the fins have a thickness at a portion thereof close to the heatsink body greater than the thickness at a portion thereof away from the heatsink body.

4. The LED-light heatsink according to claim 1, wherein the fins have a height at a portion thereof close to the heatsink baseplate greater than the height at a portion thereof away from the heatsink baseplate.

5. The LED-light heatsink according to claim 1, wherein the fins are provided with a bifurcation at a portion thereof close to the heatsink baseplate.

6. The LED-light heatsink according to claim 1, wherein the heatsink baseplate is provided thereon with at least one open hole corresponding to a single LED-light.

7. The LED-light heatsink according to claim 1, wherein an average height H of the fins is 3-4 times larger than a spacing d between the fins.

8. The LED-light heatsink according to claim 1, wherein an average thickness C of the heatsink baseplate is 2-3 times larger than an average thickness m of the fins.

9. The LED-light heatsink according to claim 1, wherein an average thickness C of the heatsink baseplate is 4.5-5.8 mm.

10. The LED-light heatsink according to claim 1, wherein a spacing d between the fins is 3.3-4.5 mm, an average thickness m of the fins is 2.0-2.7 mm, an average height H of the fins is 6.5-9.0 mm, and a length l of the fins is 40-50 mm.

11. The LED-light heatsink according to claim 1, wherein a number N of the fins is 16, 18 or 20.

12. A light-emitting diode (LED) lamp, comprising: an LED-light heatsink in accordance with claim 1, and at least one single LED-light located within the LED-light heatsink.

13. The LED-light heatsink according to claim 2, wherein the angle is in a range of 80-45°).

14. The LED-light heatsink according to claim 2, wherein the angle is in a range of 80-60°.

15. An LED-light heatsink, comprising:

a hollow heatsink body; and a heatsink baseplate provided at one end of the heatsink body, wherein the heatsink body is provided with a plurality of fins on an exterior wall thereof;

the heatsink baseplate has a thickness at a center greater than the thickness at an edge thereof; and a spacing d between the fins is 3.3-4.5 mm, an average thickness m of the fins is 2.0-2.7 mm, an average height H of the fins is 6.5-9.0 mm, and a length l of the fins is 40-50 m.

16. The LED-light heatsink according to claim 15, wherein the fins are formed with a certain angle to the exterior wall of the heatsink body, and the angle is less than 90°.

17. The LED-light heatsink according to claim 15, wherein the fins have a thickness at a portion thereof close to the heatsink body greater than the thickness at a portion thereof away from the heatsink body.

18. The LED-light heatsink according to claim 15, wherein the fins have a height at a portion thereof close to the heatsink baseplate greater than the height at a portion thereof away from the heatsink baseplate.

19. The LED-light heatsink according to claim 15, wherein the fins are provided with a bifurcation at a portion thereof close to the heatsink baseplate.

20. The LED-light heatsink according to claim 15, wherein the heatsink baseplate is provided thereon with at least one open hole corresponding to a single LED-light.

* * * * *

UNITED STATES PATENT AND TRADEMARK OFFICE

CERTIFICATE OF CORRECTION

PATENT NO. : 9,182,082 B2
APPLICATION NO. : 13/805720
DATED : November 10, 2015
INVENTOR(S) : Ling Zhu It is certified that error appears in the above-identified patent and that said Letters Patent is hereby corrected as shown below:

In the Claims

In claim 15, last line (column 8, line 25), delete "40-50m" and insert --40-50mm--.

Signed and Sealed this
Seventeenth Day of May, 2016

Michelle K. Lee

Michelle K. Lee
*Director of the United States Patent and Trademark Office*